US006533634B1

(12) United States Patent
Sugar

(10) Patent No.: US 6,533,634 B1
(45) Date of Patent: Mar. 18, 2003

(54) FIGURINE ASSEMBLY

(76) Inventor: Brenda L. Sugar, 2006 S. Lenaview Cir, Bennett, CO (US) 80102

( * ) Notice: Subject to any disclaimer, the term of this patent is extended or adjusted under 35 U.S.C. 154(b) by 0 days.

(21) Appl. No.: 10/006,274

(22) Filed: Dec. 7, 2001

(51) Int. Cl.[7] ..... A63H 3/00

(52) U.S. Cl. ..... 446/72; 446/177; 446/325; 446/268; 446/486; 40/411; 40/414; 40/744; 119/707

(58) Field of Search ..... 446/72, 325, 351, 446/486, 177, 97, 121, 268; 40/418, 424, 415, 419, 420, 421, 411, 597, 593, 613; D21/412, 418, 576, 585, 593, 594, 596, 604, 621, 632, 649, 635; D11/131, 136, 150, 160

(56) References Cited

U.S. PATENT DOCUMENTS 2,243,912 A * 6/1941 Legler
D138,777 S * 9/1944 Lewis
2,439,104 A * 4/1948 Sandell
D161,962 S * 2/1951 Plante
2,760,303 A * 8/1956 Del Mas
3,114,548 A * 12/1963 Taft, Jr.
3,516,193 A * 6/1970 Engelman
3,526,991 A * 9/1970 Goldfarb et al.
4,009,534 A * 3/1977 Bradt
4,352,461 A * 10/1982 Orta et al.
4,662,630 A 5/1987 Dignard et al.
D294,843 S * 3/1988 Lund ..... D21/204
4,929,181 A 5/1990 Undlin
5,046,724 A 9/1991 Sotomayer
5,072,998 A 12/1991 Oh
5,255,457 A * 10/1993 Lipson ..... 446/268
5,322,036 A * 6/1994 Merino ..... 446/325
5,391,104 A * 2/1995 George ..... 446/177
D410,986 S 6/1999 Luedke et al.
5,921,895 A 7/1999 Lynch et al.
D413,152 S * 8/1999 Chow ..... D21/635
D419,309 S * 1/2000 Leon
D426,712 S * 6/2000 Leon
6,129,606 A 10/2000 Yuen
6,264,524 B1 * 7/2001 Crane et al. ..... 446/177

* cited by examiner

*Primary Examiner*—Derris H. Banks
*Assistant Examiner*—Ali Abdelwahed

(57) ABSTRACT

A figurine assembly is for providing a user with an attractive and functional device that would be used to decorate a computer monitor. The figurine assembly includes a figurine that has a torso, head, arm and leg portions. A base member is adapted for coupling to a top of the computer monitor. A spring member has a first end coupled to the base member and a second end coupled to the body portion. The spring member has a spring constant such that the figurine moves with an exaggerated motion when the movement of the computer monitor moves the base.

8 Claims, 4 Drawing Sheets

FIGURINE ASSEMBLY

BACKGROUND OF THE INVENTION

1. Field of the Invention

The present invention relates to figurine assemblies and more particularly pertains to a new figurine assembly for providing a user with an attractive and functional device that would be used to decorate a computer monitor.

2. Description of the Prior Art

The use of figurine assembly is known in the prior art. U.S. Pat. No. 6,129,606 describes a device for providing an action mechanism to a toy or amusement device. Another type of figurine assemblies is U.S. Pat. No. 5,072,998 having plush stuffed anatomical members for mounting on a computer monitor. U.S. Pat. No. 5,046,724 describes a punching device for boxers. U.S. Pat. No. 5,921,895 describes a device used for martial arts training having a pair of spaced springs. U.S. Pat. No. 4,662,630 describes a martial arts striking apparatus including a striking board and mounting apparatus. U.S. Pat. No. Des. 410,968 describe an ornamental design for a kickboxing exercise device.

While these devices fulfill their respective, particular objectives and requirements, the need remains for a device that includes a picture frame for personalizing the device to meet the specification of the user.

SUMMARY OF THE INVENTION

The present invention meets the needs presented above by allowing the user to personalize the device by adding the picture of their choosing.

Still yet another object of the present invention is to provide a new figurine assembly that would allow the user to personalize their computer and server as a conversation piece.

Even still another object of the present invention is to provide a new figurine assembly that would also serve as a way to blow off steam, as the user could punch the present invention whenever the user becomes annoyed with their computer.

To this end, the present invention generally comprises a figurine that has a torso, head, arm and leg portions. A base member is adapted for coupling to a top of the computer monitor. A spring member has a first end coupled to the base member and a second end coupled to the body portion. The spring member has a spring constant such that the figurine moves with an exaggerated motion when movement of the computer monitor moves the base.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty, which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
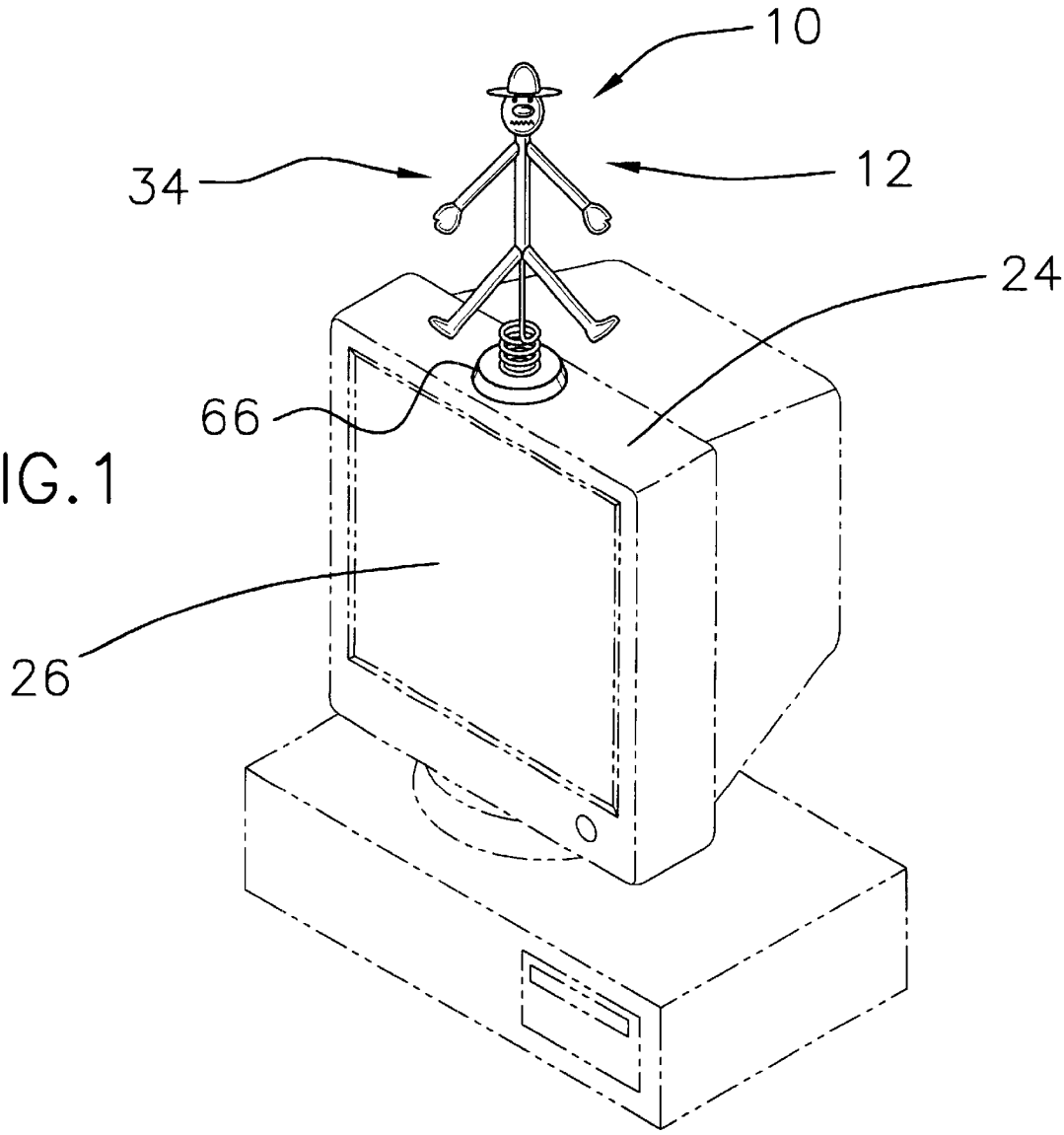
FIG. 1 is a perspective view of a new figurine assembly according to the present invention.
Figure 2:
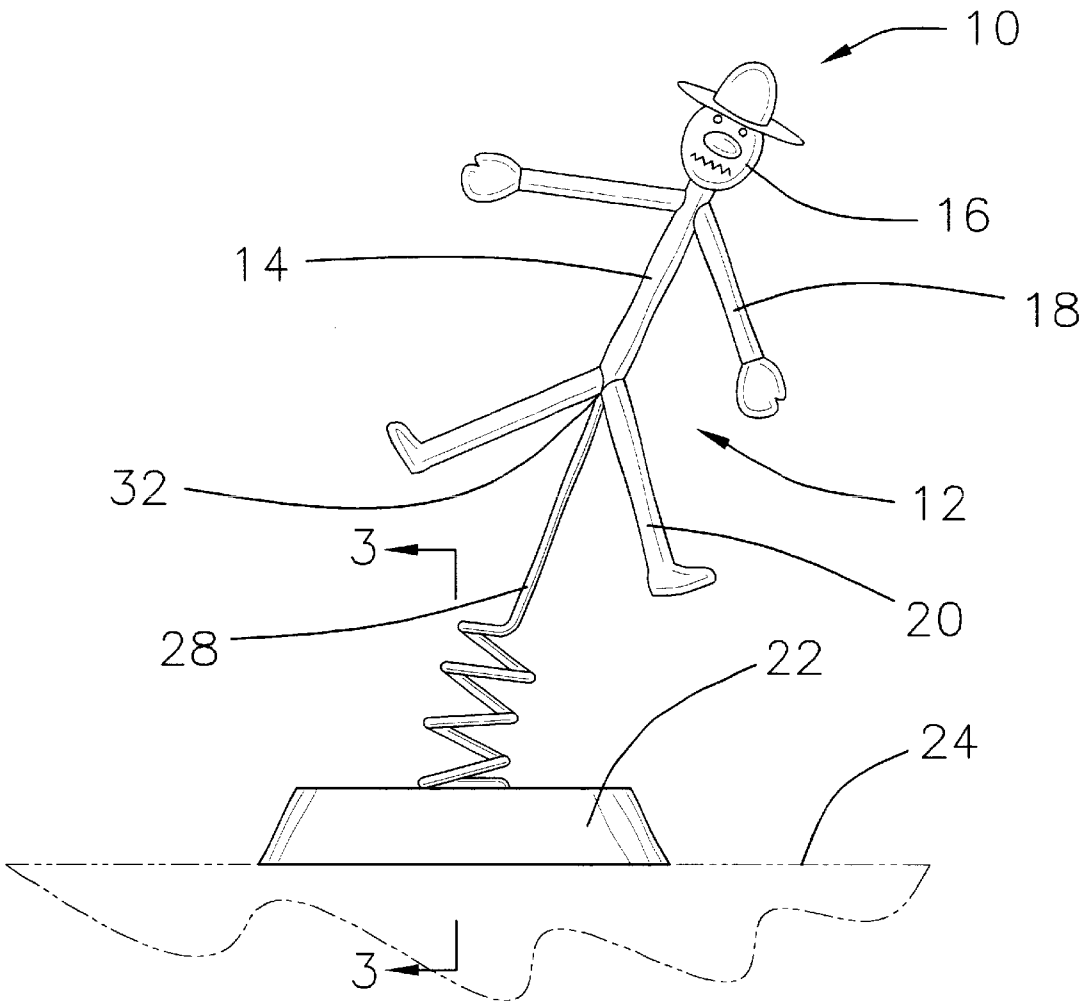
FIG. 2 is a front view of the present invention.
Figure 3:
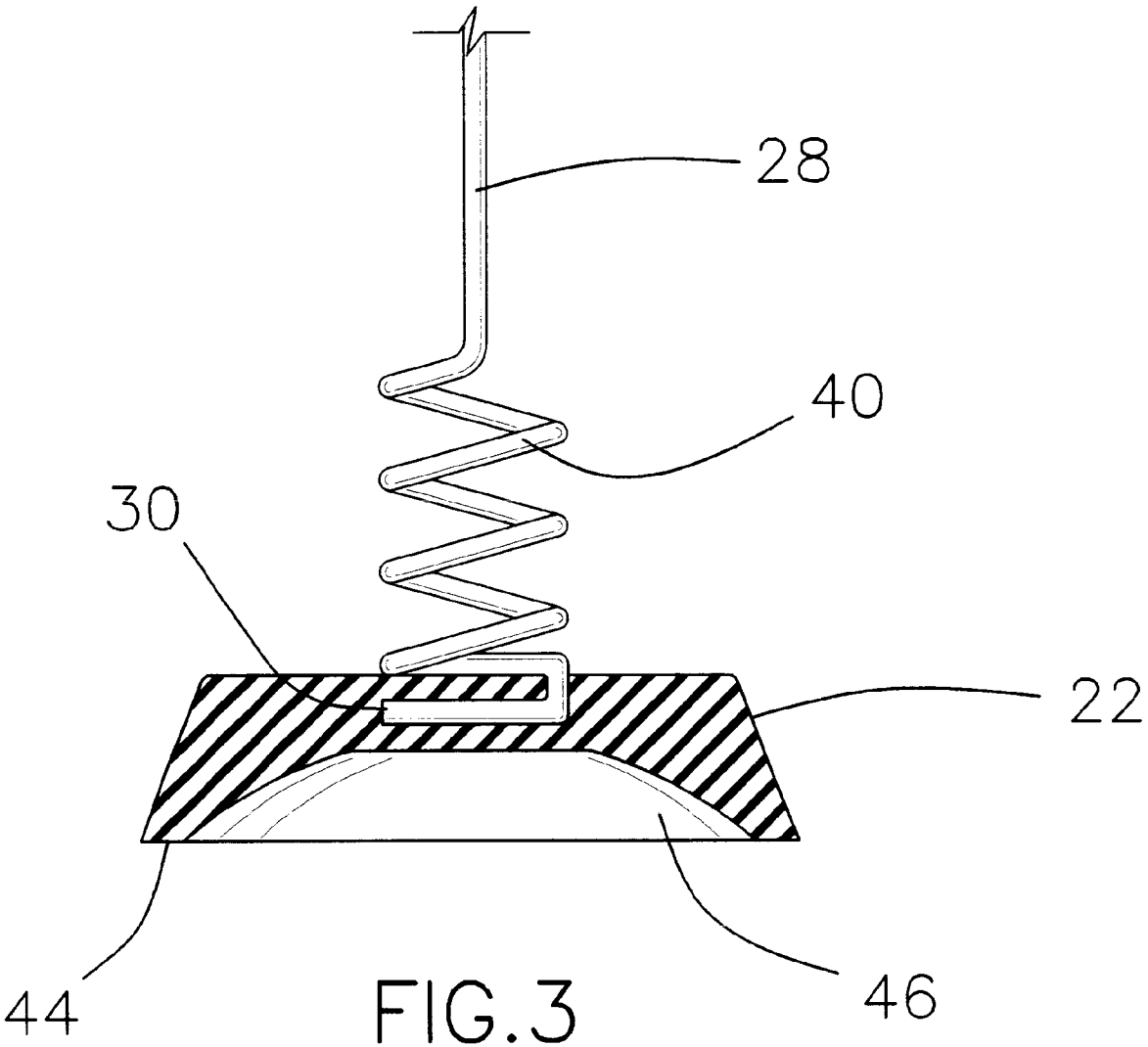
FIG. 3 is a cross-sectional view of the present invention.
Figure 4:
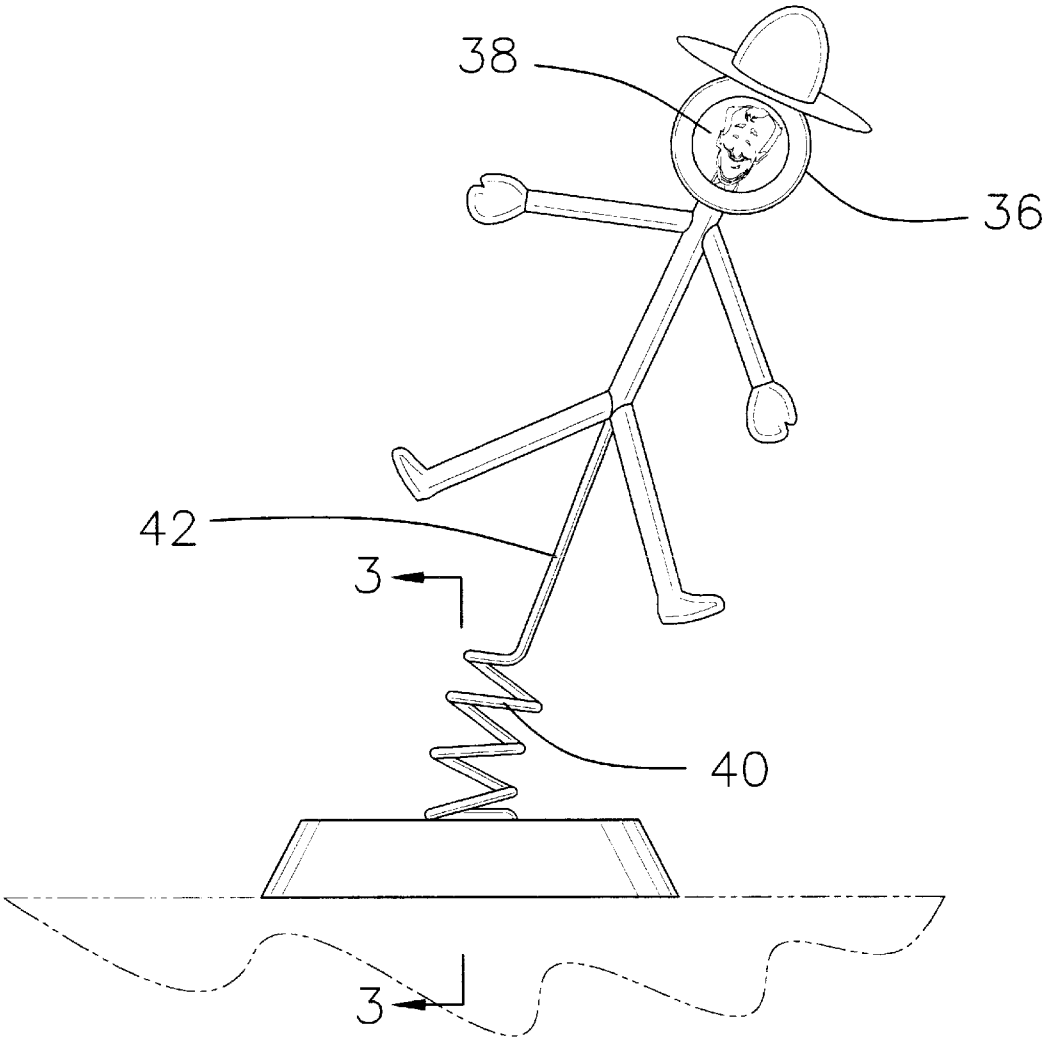
FIG. 4 is a front view of the present invention.

With reference now to the drawings, and in particular to FIGS. 1 through 3 thereof, a new figurine assembly embodying the principles and concepts of the present invention and generally designated by the reference numeral 10 will be described.

As best illustrated in FIGS. 1 through 3, the figurine assembly 10 generally comprises a figurine 12 that has a torso 14, head 16, arm 18 and leg 20 portions. A base member 22 is adapted for coupling to a top 24 of the computer monitor 26. A spring member 28 has a first end 30 coupled to the base member 22 and a second end 32 coupled to the body portion 34. The spring member 28 has a spring constant such that the figurine 12 moves with an exaggerated motion when movement of the computer monitor 26 moves the base member 22.

The head 16 portion of the figurine 12 includes a picture frame 36 adapted for displaying a photo 38. The spring member has a coiled portion 40 adjacent to a top 66 of the base member 22 and a straight extension portion 42 for extending upwardly from the coiled portion 40. The spring member 28 has a generally L-shaped proximal end embedded in the base member 22 for preventing disengagement of the spring member 28 from the base member 22.

In an embodiment the figurine assembly has an adhesive 44 coupled to a bottom of the base member 22 whereby the base member 22 is adapted for affixing to the top of the computer monitor 26. The base member 22 is constructed of a resilient material, the base member 22 has a recessed portion in a bottom of the base member whereby the base member 22 forms a suction cup 46 such that the base member 22 is adapted for removably coupling to the top of the computer monitor 26.

In use, the user would attach the present invention to the top of the computer monitor utilizing the adhesive base or the suction cup base. Once in place, the unit would provide a decorative touch to the monitor and would also serve as an outlet for frustration. When the user becomes annoyed with their computer, they could punch the figurine.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A figurine assembly for positioning on a computer monitor, said figurine assembly comprising:

a figurine having a torso, head, arm and leg portions;

a base member adapted for coupling to a top of the computer monitor;

a spring member having a first end fixedly coupled to said base member and a second end fixedly coupled to a body portion of said figurine, said spring member having a spring constant such that said figurine moves with an exaggerated motion when said base is moved by movement of the computer monitor; and said spring member having a vertically oriented coiled portion adjacent to a top of said base member and a vertically oriented straight extension portion extending upwardly from said coiled portion.

2. The figurine assembly of claim 1, further comprising:

said head portion of said figurine including a picture frame adapted for displaying a photo.

3. The figurine assembly of claim 1, further comprising:

an adhesive coupled to a bottom of said base member whereby said base member is adapted for affixing to the top of the computer monitor.

4. The figurine assembly of claim 1, further comprising:

said base member being constructed of a resilient material, said base member having a recessed portion in a bottom of said base member whereby said base member forms a suction cup such that said base member is adapted for removably coupling to the top of the computer monitor.

5. The figurine assembly of claim 1, further comprising:

said spring member having an L-shaped proximal end embedded in said base member for preventing disengagement of said spring member from said base member.

6. A figurine assembly for positioning on a computer monitor, said figurine assembly comprising:

a figurine having a torso, head, arm and leg portions;

a base member adapted for coupling to a top of the computer monitor;

a spring member having a first end fixedly coupled to said base member and a second end fixedly coupled to a body portion of said figurine, said spring member having a spring constant such that said figurine moves with an exaggerated motion when said base is moved by movement of the computer monitor;

said head portion of said figurine including a picture frame adapted for displaying a photo;

said spring member having a vertically oriented coiled portion adjacent to a top of said base member and a vertically oriented straight extension portion extending upwardly from said coiled portion; and said spring member having an L-shaped proximal end embedded in said base member for preventing disengagement of said spring member from said base member.

7. The figurine assembly of claim 6, further comprising:

an adhesive coupled to a bottom of said base member whereby said base member is adapted for affixing to the top of the computer monitor.

8. The figurine assembly of claim 6, further comprising:

said base member being constructed of a resilient material, said base member having a recessed portion in a bottom of said base member whereby said base member forms a suction cup such that said base member is adapted for removably coupling to the top of the computer monitor.

* * * * *